US005357857A

United States Patent [19]

Zimmer

[11] Patent Number: 5,357,857

[45] Date of Patent: Oct. 25, 1994

[54] MAGNETICALLY PRESSED DOCTOR BLADE FOR CYLINDRICAL-SCREEN STENCIL

[76] Inventor: Johannes Zimmer, Ebentaler Str. 133, A-9020 Klagenfurt, Austria

[21] Appl. No.: 39,504

[22] Filed: Mar. 29, 1993

Related U.S. Application Data

[63] Continuation of Ser. No. 761,882, filed as PCT/AT90/00010, Jan. 16, 1991, and published as WO91/10567, Jul. 25, 1991, abandoned.

[30] Foreign Application Priority Data

Jan. 17, 1990 [AT] Austria ..... 92/90
Jan. 26, 1990 [AT] Austria ..... 181/90

[51] Int. Cl.[5] ..... B41L 13/04

[52] U.S. Cl. ..... 101/120; 101/119; 101/123; 118/110

[58] Field of Search ..... 101/118, 119, 120, 123, 101/124; 118/110, 112, 119

[56] References Cited

U.S. PATENT DOCUMENTS 3,592,132 7/1971 Weber ..... 101/119
3,807,302 4/1974 Kudlich ..... 101/120
3,921,521 11/1975 Kudlich ..... 101/120
4,920,914 5/1990 Zimmer ..... 101/120
4,955,298 9/1990 Zimmer ..... 101/120

FOREIGN PATENT DOCUMENTS 389676 1/1990 Austria .
0311728 10/1987 European Pat. Off. .
0311743 5/1988 European Pat. Off. .
2450231 4/1975 Fed. Rep. of Germany .
2364122 9/1977 France .
WO8903259 4/1989 World Int. Prop. O. .

*Primary Examiner*—Edgar S. Burr
*Assistant Examiner*—Lynn D. Hendrickson
*Attorney, Agent, or Firm*—Herbert Dubno; Andrew Wilford

[57] ABSTRACT

Doctor blade and doctor blade device for the application of flowable substances on flat surfaces with a doctor blade profiled rod and a doctor blade element, a magnetic device is assigned to the doctor blade, the arrangement, shape, strength of the magnetic field produced by this device determines the local position of the doctor blade, and additionally through this magnetically determined position and fixation and through device parts, the angular position of the doctor blade is also adjusted, whereby the doctor blade has limited freedom of movement.

13 Claims, 4 Drawing Sheets

MAGNETICALLY PRESSED DOCTOR BLADE FOR CYLINDRICAL-SCREEN STENCIL

CROSS REFERENCE TO RELATED APPLICATIONS

This application is a continuation of Ser. No. 07/761,882 filed 16 Sep. 1991 (now abandoned) as a national phase application of PCT/AT91/00010 filed 16 Jan. 1991 and based upon Austrian applications A 92/90 and A 181/90 filed respectively on 17 Jan. and 26 Jan. 1990 under the International Convention.

FIELD OF THE INVENTION

The invention relates to a coating machine comprising a doctor blade or profiled rod and a magnetic device for the application of flowable substances on flat or cylindrical printing screens.

BACKGROUND OF THE INVENTION

Doctor blade devices operating with magnetically generated pressing forces are known. Doctor blade rods which are either made entirely of magnetizable material or are made of several parts of which at least one is magnetizable are also known, either as components of doctor blade devices or, in some special cases, as a magnetizable cylindrical bar (magnetic roll wiper) operating by itself as a doctor blade device.

Further a spreading blade device is known, which is constructed as a spreading blade profiled rod or as a twin spreading blade and consists of two such spreading blade profiled rods supported at its ends in a roller guide, i.e. each in a respective guide roller, by means of axle pivots.

In the case of the magnetic roll wiper, the available magnetic force acts primarily to press the wiper against a substrate and is, as a secondary function, a location-determining force. This location-determining action derives from the magnetically performed main function resulting from the pressure exerted upon the doctor device, without reducing thereby the pressure force in any way.

In the case of the spreading blade, or the twin spreading blade profiled rod, which laterally is roller-supported or roller-guided, the situation is different. The pressure exerted upon the doctor blades is weakened by two factors: namely of which the first factor the weight of the doctor blade profiled rod supported to a large extent by lateral roller guides and because the magnetic force generated by the magnetic device in the magnetizable part of the spreading blade acts only partially as a pressure force. A fraction of this latter force acts just like the inherent weight through the axial pivots upon the lateral roller guides, and is not effective to the application process as pressure force, i.e. as the actually working force.

A laterally roller-guided doctor blade device like the one described above is just as much exposed to the danger of bending as any other doctor blade device held or fastened at its ends. As is known, with increasing work width or length of the profiled rods or increasing magnetic pressing force, this bending danger increases with the square of the application width, or the length of the doctor blade device.

As opposed to the magnetically pressed doctor blade devices, magnetically pressed spreading blade devices of the aforementioned kind have not proven to be useful in practice.

A drawback of the blades described above is the fact that the amount of substance to be applied is determined by the diameter of the wiper roller and therefore changes in the output of substance to be applied can be brought about only by modifying the diameter of the roller, i.e. by replacing one wiper roller with a diameter A with another wiper roller of a diameter B, which can be done only by interrupting the operation.

The disadvantage described above has been partially overcome with doctor roller devices having a profiled rod fastened to the doctor blade device upstream of the wiper roller considered in the direction of movement, this profiled rod being movable per se as an element or being movable via the doctor blade device, i.e. its local position with respect to the application zone is changeable. With auxiliary or additional devices of this kind it is possible within certain limits to perform a certain quantitative control also during operation, without having to interrupt production.

OBJECT OF THE INVENTION

It is therefore the principal object of the invention to provide a doctor roller device completely overcoming the disadvantages of the prior art.

SUMMARY OF THE INVENTION

The doctor blade device of the invention has one roller, of the spreading blade device—a profiled rod with a doctor blade or spreading element and is designed and mounted so that the magnetically generated force is entirely or at least preponderantly directed to the doctor blade as the pressure force for pressing the doctor blade against a substrate. The local position of the doctor blade is determined by the position of the magnetic device as well as by the configuration and strength (intensity) of the magnetic field. The doctor blade therefore is freely movable and is limited only by parts of the device or by a stencil, and within a space defining the mobility of the doctor blade the latter can determine its optimal location for the respective stage of operation by using magnetic force and optionally through the speed of the operation and through friction value and dynamic pressure parameters.

A further advantageous embodiment of the doctor blade device of the invention has the doctor blade connected to the doctor blade device in such a manner that the doctor blade can be swung about a longitudinal axis of the doctor blade, e.g. about its application edge or application rounded edge (coating edge) without any limitation to its capability of self-determining location, whereby via a modification of the dynamic pressure in the substance to be applied a change in the amounts of applied substance can be made.

If the profiled rod is designed as a spreading blade rod, then the parts of the device responsible for the swivelling, or axial pivoting of the spreading blade rod can be built so that it simultaneously insures the mobility of the spreading blade rod approximately perpendicular to the application plane effected through the changes in the magnetic pressure force, without diverting in the device any magnetically produced forces.

This feature of the device of the invention is particularly important and advantageous because the spreading blade devices operating with magnetic force known to the state of the art determine the location of the spreading rod by auxiliary mechanical means, so that the magnetic forces acting upon the spreading rod can produce warping, distortions and vibrations, which have a disturbing influence on the application process.

In addition to the features mentioned above, the invention is also characterized by the advantageous, mutually complementary combinations of several other features which are mentioned here below:

1. the application of dynamic pressure in the area where the doctor blade makes contact with the substrate,
2. the pressure generated by magnetic force,
3. location determined by magnetic force,
4. the movability for the purpose of adjustments to the conditions of the operation, or the adjusting location correction,
5. swingability or axial pivotability of the doctor blade profiled rod about one of the possible longitudinal axes of the profiled rod or about the axis of the doctor roller, in case the rod is equipped with such a doctor roller,
6. the combination of device parts which make possible the control of the swivel or pivoting motions of the doctor blade profiled rod, as well as the reproducibility of the adjustment of these swivel or pivoting motions,
7. the double function of the mentioned control components for holding (suspending) the doctor blade profiled rods on the doctor blade device when it is not in operation, which means when the magnetic device is not functioning, for the removal of the doctor blade device from the application surface or stencil and for the mounting or dismounting in the machine.

Another characteristic feature of the invention which has to be emphasized is the fact that the swivel axis of the doctor blade or the doctor blade device is only an axis generated by magnetic force, i.e. to a certain extent only an imaginary axis of a center of magnetic field action. This is actually the very basic concept of the invention serving as a foundation for all other facts connected to the invention.

It is also characteristic for the invention that the doctor blade or doctor blade device can be modified by various auxiliary means as to its position or its spatial arrangement with respect to the application zone (to the zone where the doctor blade is pressed against the substrate): vertical sliding, horizontal sliding, diagonal sliding, change of position along a circular arc or, for instance, rotation of the doctor blade device (this is not to be confused with the pivoting of the doctor blade profiled rod) around an axis of the device, e.g. the axis of the substance-supply pipe whereon the support of the doctor blade device is mounted.

The control of the swivel motion or the axial pivoting of the doctor blade rod can also be achieved by a so-called link motion or linkages with levers. For instance, a lever arm or connection bracket with a hinge at each end of the bracket or the lever-like connection part can be utilized.

If the doctor blade rod is designed as a doctor roller rod, the doctor blade device can be equipped with variously shaped rods or with doctor rollers of various diameters, whereby the rods themselves can be differently shaped.

If the doctor blade profiled rod is a spreading blade rod it can also have different shapes and can be equipped or formed with differently shaped and dimensioned spreading blade elements.

Further configuration possibilities of doctor roller rods which are important for their effects and advantageous for various operational requirements consist in that the rod can be provided with a recess shaped like a slide bearing wherein a doctor roller can be contained up to approximately two thirds of its peripheral surface, whereby the frontal edge situated in front of the roller in the direction of motion defines this slide-bearing-shaped recess and reaches very closely to the application surface or stencil. This distance is reduced to 1 mm—and even less.

The doctor roller inserted in the roller rod can be provided with a structured surface preventing the formation of substance drops at the rear edge of the slide bearing, considered in the direction of motion.

An additional advantage is the economical use of substance application which is achieved by inserting the doctor roller in the roller rod nonrotatably. This can be done by pinning them together. This embodiment is based on the finding that a nonrotating doctor roller, which means a doctor roller inserted as round-rod spreading blade applies one third less substance than a rotating roller of the same diameter, wherefrom new inventive steps can be derived.

Not only the location of the doctor roller—seen in the direction of motion—is determined by a mechanism, but also the axial position of the doctor blade element is predetermined by the doctor blade device.

In the case of a known doctor blade device operating with magnetic pressing force, the magnetic force is used for pressing the doctor blade against the substrate, rarely also as a secondary, auxiliary force for location determination. The location determination is always effected in conjunction with mechanical means. It is for the first time in the present invention that the magnetic force is given a second main function in addition to determining the pressure exerted upon the doctor blade. The magnetic force, generated by the device is the only means to be responsible for the location determination, without the assistance of mechanical means. Hence, the orientation of a magnetically pressed doctor blade device with a doctor roller or a spreading blade is determined exclusively by magnetic force. Furthermore, the device of the invention is characterized by the exclusively magnetically held doctor blade element having an additional nonmagnetizable or only partially magnetizable part.

According to the invention, three work functions are assigned to the magnetic force:

1. application of the usual pressure exerted upon the doctor blade element,
2. the determination of its local position,
3. its positioning and holding of a further additional part which is connected in one piece with the doctor blade element or the doctor blade edge.

According to the invention, the connection part which connects the magnetically held work parts with the parts mechanically mounted or supported on the machine has only the control function for the determination of the angular position of the doctor blade profiled rod rotating around the doctor blade element or together therewith.

According to the invention these connecting parts controlling the angular position through sliding contact also fulfill a holding function only during the stillstand of the installation.

This secondary holding function, which is not allowed to become effective while the installation operates, makes it possible to handle the entire installation—including preferably the substance feeding conduit—as a single unit. This facilitates the assembly and disassembly of the installation, selection to select during assembly of the approximately a suitable local position of the doctor blade element for the desired operational state by the magnetic force and also makes possible the removal of the doctor blade arrangement when production is interrupted for a short time or the magnetic field is disconnected.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
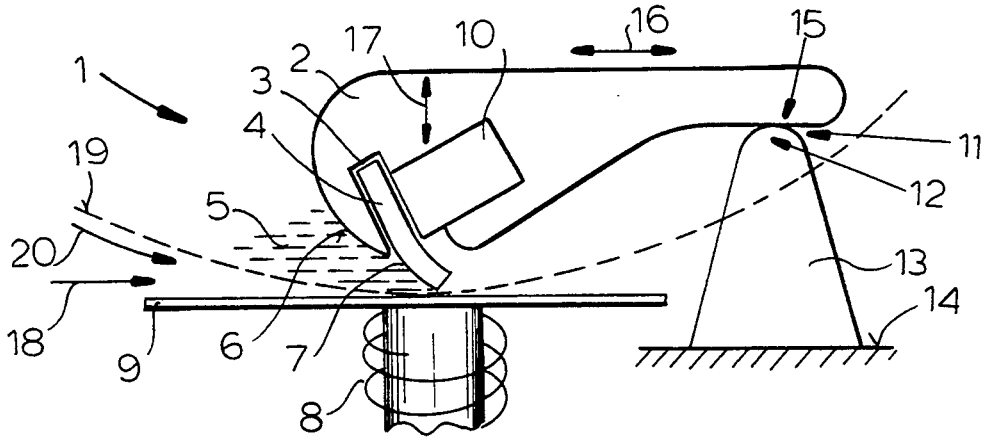
FIG. 1 is a diagrammatic cross section of an embodiment in which the doctor blade element has a projection resting on a support laterally of the screen, a magnetically attractable body inserted in the doctor blade, and a bent blade element received therein.

FIGS. 1 to 4 illustrate the magnetic self-positioning according to the invention in several embodiments of the profiled bar 2 receiving profiled spreading blades 4 (FIGS. 1, 2), elastic blade 28 (FIG. 3) and doctor roller 30, with magnetizable parts 10 provided in addition to the doctor blade 4, 28 or roller 30.

In FIG. 1 a doctor blade holder in the form of a bar 2 according to the invention is provided. The doctor blade 4 itself is made of a pressure-resistant and bending resistant sectional body and is inserted in the holding recess 3 as the coating element. The substance to be applied 5 lies upstream of the coating element against a retaining surface 6 of the profiled bar 2 and against the retaining surface 7 of the doctor blade element 4. The retaining surface of the doctor blade element 4 is curved. Further, the doctor blade element 4 carries a magnetizable mass 10 which can be made of several parts. The doctor blade bar 2 has an extension 15, which in the region 11 rests against the area 12 of a support part 13 which is laterally mounted in front or behind a stencil 19. The profiled bar 2 can move back and forth in the direction of arrow 16, namely in or against the direction of motion 18 of the application surface 9, or in or against the motion direction 20 of the stencil 19 as shown in FIG. 1.

There is also a movability in the direction of arrow 17, perpendicularly or approximately with respect to the application surface 9. The embodiment of FIG. 2 corresponds to that of FIG. 1, but here a support 51 for the doctor blade bar 2 rests directly against an inner wall of the stencil 19 in the area 21.

Figure 2:
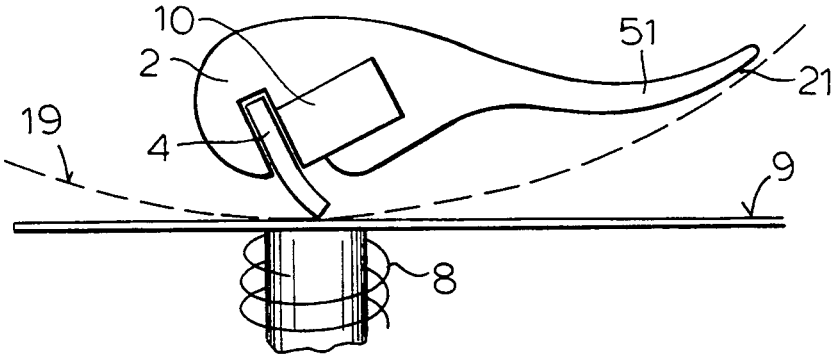
FIG. 2 is an embodiment similar to FIG. 1, wherein, however, the projection of the doctor element rests against the inner surface of the drum.
Figure 3:
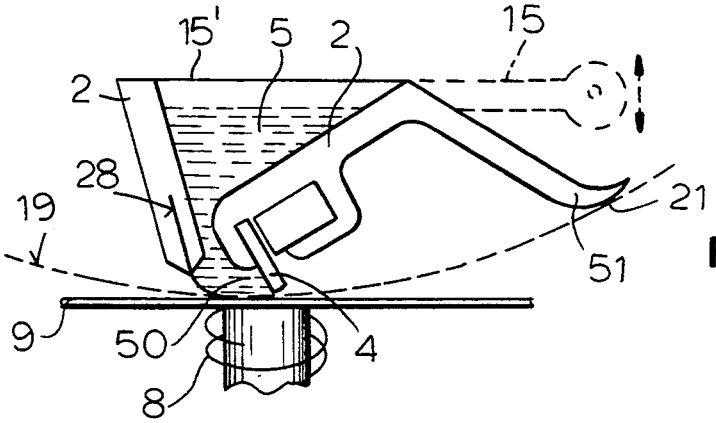
FIG. 3 is a similar view of an embodiment analogous to that of FIG. 2 but further equipped with the reservoir for the substance to be applied to the web.

FIG. 3 is derived from FIG. 2 and has in addition to the structure of the latter a demarcation wall connected with the doctor blade rods 2 and 2' formed with the elastic blade 28 which rests against the cylindrical screen or stencil 19, or against the application surface 9. Thereby, in the upper area a trough and in the lower application area an application gap are formed.

Figure 4:
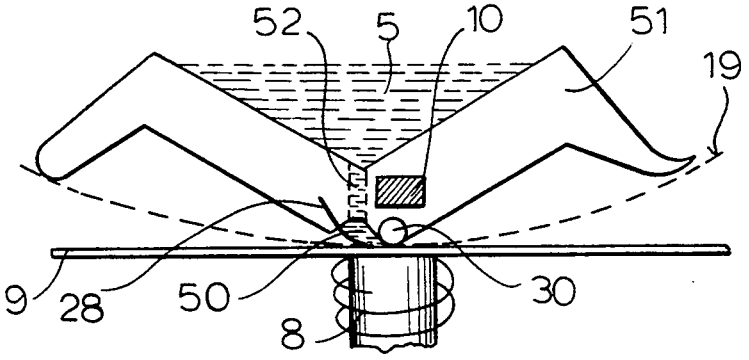
FIG. 4 is a diagrammatic section of an embodiment functioning similarly to that of FIG. 3, but with supports on both sides of the wiper region against the pattern drum.

FIG. 4 shows a device similar to that of FIG. 3, but made in one piece, with a round rod serving as a doctor blade element, which optionally can be rotatably or nonrotatably mounted. Therefore, in addition to the support area 21 the device has another symmetrically arranged support area. This eliminates the danger of a possible tipping of the device towards one of the two sides. As can be seen, here between the doctor blade element 28 and the roller 30 an application gap 50 is formed, through whose passage 52 the supplied application substance 5 can reach the application surface 9.

Figure 5:
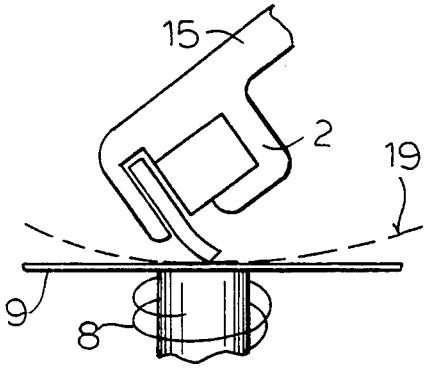
FIGS. 5 to 7 are diagrammatic cross sections illustrating other orientations of a doctor blade.
Figure 6:
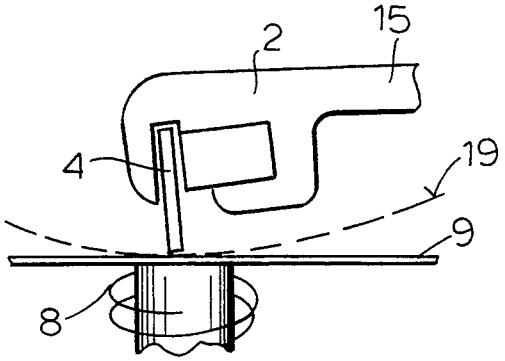

FIGS. 5 and 6 show various positions of a device of the invention according to FIG. 1 for different application outputs. These positions are achieved by actuating a device by a means shown in FIG. 8 and slidably supporting the extension 15 as in FIGS. 1–4 for example.

Figure 7:
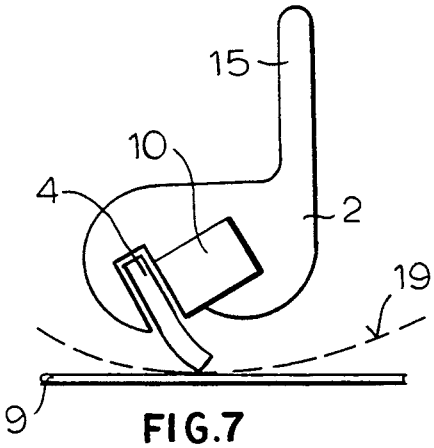

In FIG. 7, the extension 15 is directed away from the cylindrical screen 19 and the support areas are not shown. The support shown in FIGS. 13 and 14 can be utilized in this particular embodiment.

Figure 8:
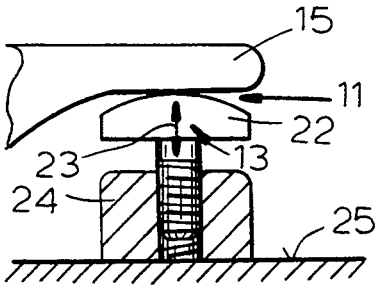
FIGS. 8 to 9 are cross sectional views showing two different supports for a doctor blade capable of moving in the direction of movement of the web and pivoting relative to the support.

FIG. 8 offers a cooperation possibility between the extension 15 and the support part 13. The support part 13 is here shaped like a head 22 and is movable in the direction of arrow 23. The support part 13 engages in a stationary counterpiece 24 which is fastened to a plate 25.

Figure 9:
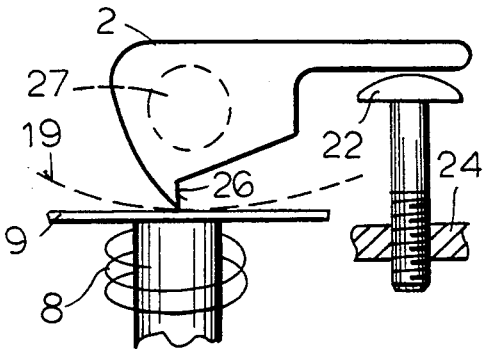

According to FIG. 9, which combines features of FIG. 1 and FIG. 8, the doctor blade rod 2 is made in one piece and with a profiled edge 26 it is possible to insert a magnetizable mass 27 with a for instance circular cross section, if the doctor blade rod 2 is not made of magnetizable material.

Figure 10:
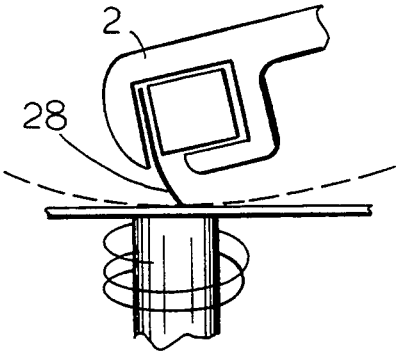
FIGS. 10 to 12 are cross sectional views illustrating different embodiments of the working element associated with the doctor blade.

FIG. 10 is similar to embodiments shown in FIGS. 1 to 7, but here the elastic blade 28 is thin and elastically bendable.

Figure 11:
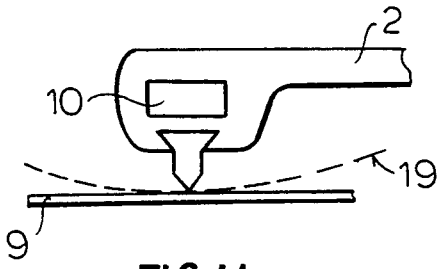

In FIG. 11, which is similar to FIG. 10, the doctor blade rod 2 has a further profiled rod 29 and a magnetizable mass 10, for the case that neither the profiled rod 29 nor the doctor blade rod 2 are made of magnetizable material or optionally for enhancing the magnetically generated pressure.

Figure 12:
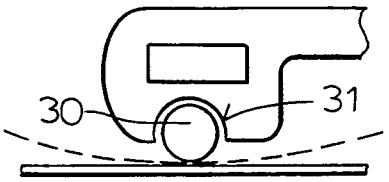

In FIG. 12, the profiled rod 29 is replaced by the roller 30, which is contained in a slide-bearing-like recess 31 which surrounds one half of the roller.

Figure 13:
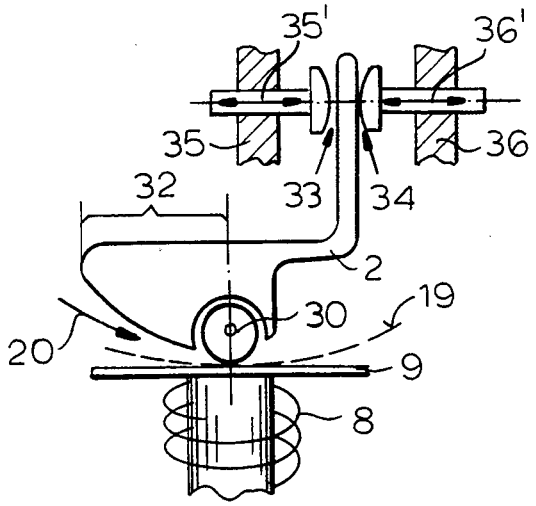
FIGS. 13 and 14 are diagrammatic sections illustrating other supports cooperating with the doctor blade when the magnetic force is discontinued.

A similar embodiment is shown also in FIG. 13. Here, the profiled rod 2 rests on the application surface 9 or on the inside of screen or stencil 19 via the roller 30. The doctor blade rod 2 is shaped like that of FIG. 7, but has a projection 32 directed against the direction of motion indicated by the arrow 20, which by its weight makes it possible for the doctor blade rod 2 to tip forward against the direction of motion. Instead of the support area 11 according to FIG. 8, here there are two support areas 33 and 34 each provided with an adjustment device 35 and 36 movable horizontally as indicated by respective arrows 35' and 36'.

Figure 14:
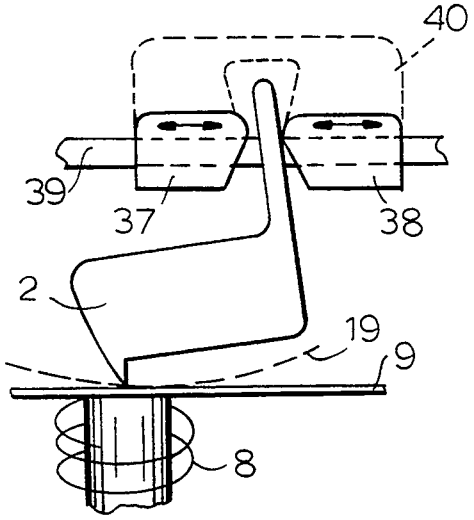

A further development is shown in FIG. 14, wherein the doctor profile 2 consists of magnetizable material and the adjustment devices 37, 38 are slidable on a rod 39, respectively can be connected to a single displacement device 40, as shown in broken lines.

Figure 15:
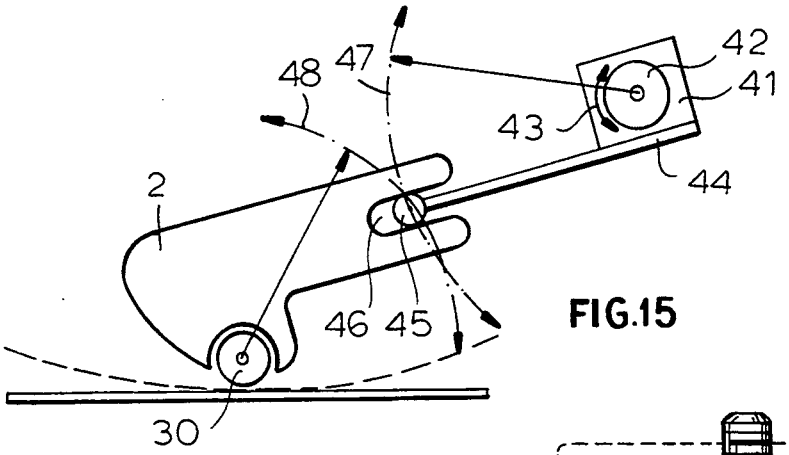
FIGS. 15 to 17 are cross sectional views showing three different systems enabling the pivoting or swivelling movement of the doctor blade relative to the support under the action of the magnetic field.

In FIG. 15 an auxiliary device 41 is rotatable around a pivot axle 42 in direction of arrow 43 and is mounted via a web 44 to a support and control profile 45, engaging a guide 46. The possible oscillation range of the doctor blade is defined by the circle-segment lines 47, 48, whereby an approaching or overlapping area of the two interengaging swivel elements, or support elements, or control elements is given.

Figure 16:
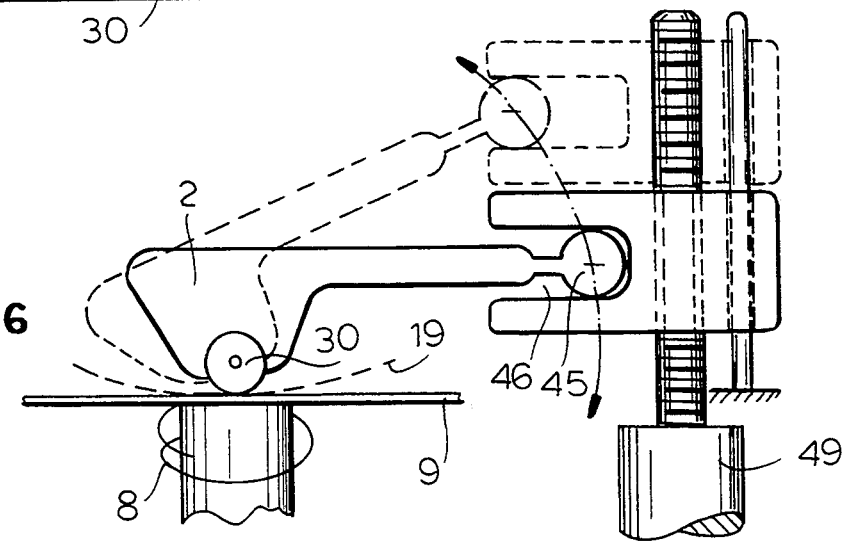

In FIG. 16, the swivel motion derives from an adjustment device 49 movable vertically or approximately vertically with respect to the application plane and the support and control elements are basically similar to the ones in FIG. 15.

In FIG. 3 another variant is shown in broken lines, wherein the device is so designed that the extension or shoulder 15 engages in a guide 46, like in FIG. 16. By swivelling the application device about the application edge of the doctor blade elements, the width of application gap 50 and thereby also the output of substance amount can be changed.

Figure 17:
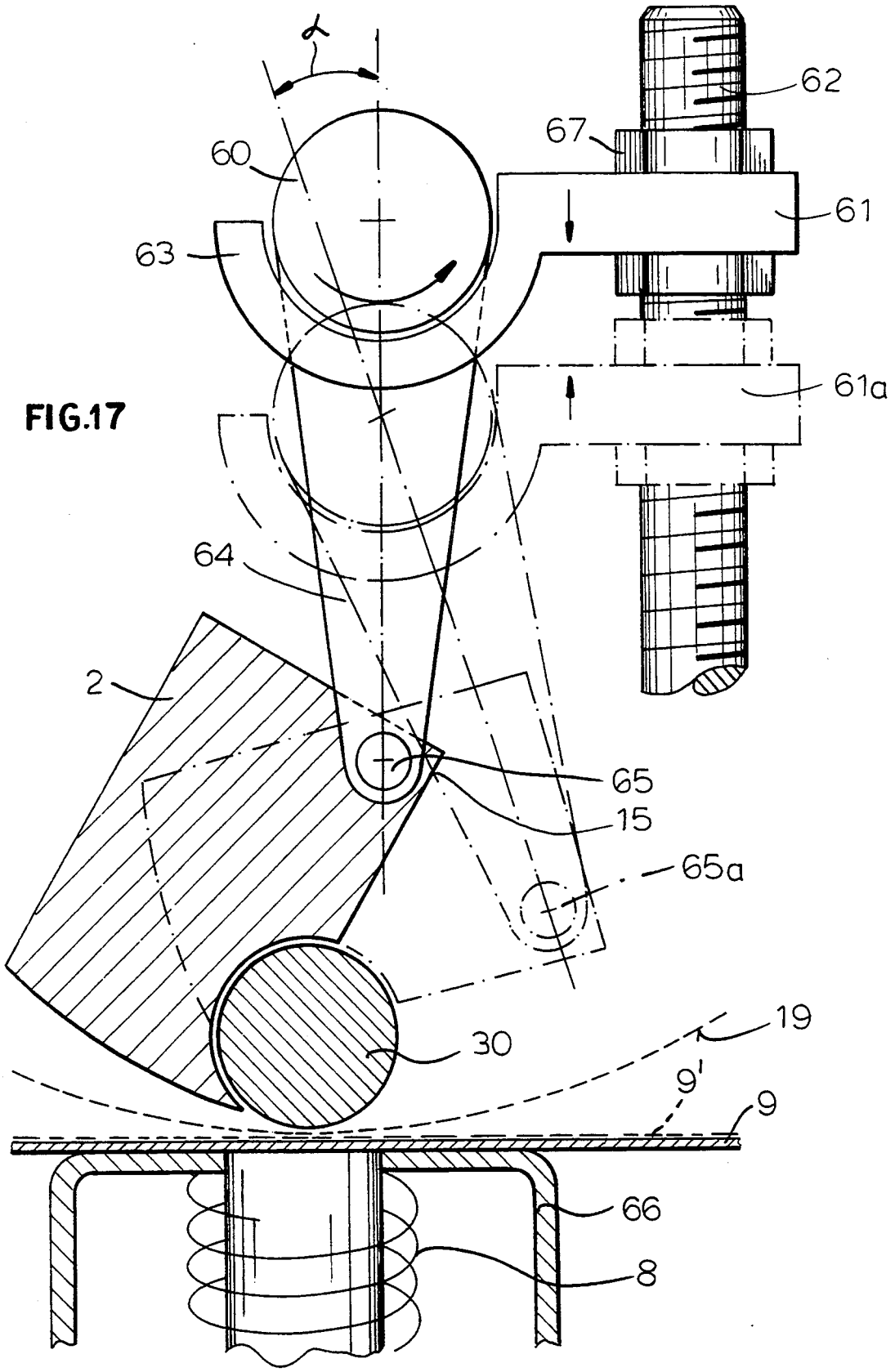

A further embodiment of the invention is shown in FIG. 17 A web of material 9', upon which a substance is to be applied, is guided over a table 66 containing a magnetic device 8. A profiled doctor blade rod 2 is provided which by means of articulation 65 is swingably connected with a projection, a holding arm, several holding arms or with a continuous bar 64. On the web of material or on the stencil 19 lies a magnetizable doctor blade element 30, which is magnetically connected to an optionally magnetizable part of the profiled doctor blade rod, so that the magnetic device 8 draws this doctor blade element 30 against the stencil or the web of material. The holding bar 64 is connected to an at least partially cylindrical part of a carrier beam 60, which is rotatably supported in a split slide bearing 63. In this embodiment, the slide bearing 63 is connected via an arm 61 with the adjustment device provided with a threaded rod 62, whereupon nuts 67 can be displaced, i.e. when the nuts 67 are rotated, the bearing shell 63 is displaced and thereby the height adjustment and therefore also the application angle of the doctor blade rod 2 is changed. Thus, the doctor blade rod can be moved in the position shown in broken lines. The doctor blade rod 2 and/or the doctor blade element, which here is shown as a round rod, consists at least partially of a magnetizable material. The magnetizable material can also have another shape or the entire doctor blade rod can consist of magnetizable material. On the profiled doctor blade rod 2 a bendable wiper blade can be fastened, as is the case for instance in FIG. 10 and also the magnetizable round rod can be fastened nonrotatably or glued in a recess of the doctor blade device.

Therefore, a combination between a fixed swivel pin joint, a displaceable, open carrying-axle slide bearing and a magnetic self-positioning thus is easily realized. Due to the steps taken in accordance with the invention, the position of the device components can be changed in vertical direction with respect to the application surface, whereby the doctor blade rod remains magnetically fixed in its ideal local position for the application process.

With the invention, it is possible to channel the magnetic force to the doctor blade rod as the pressing force and to keep the total magnetic force available in its entirety or at least almost entirely, to determine the position of the doctor blade by the position of the magnetic device and by the configuration and strength of the magnetic field, and to create the possibility that the doctor blade can determine its own position optionally depending on the speed of the operation and optionally through the friction value and dynamic pressure parameters.

Also novel is the fact that the magnetic force is used not only for pressing and positioning of the usual doctor roller, but also determines the location of a doctor blade rod, holding it in working position during operation, i.e. when the magnet system is switched on. A doctor blade having a doctor blade rod and a doctor blade element can be applied by itself to the substrate and can carry out the application operation by being kept in position only magnetically (FIG. 1).

In conjunction with cylindrical stencils, it is possible to design a doctor blade so that a part of the doctor blade is extended towards the rear, considered in the direction of motion, and rests with minimal weight against the inner wall of the cylindrical printing screen (FIG. 2). It is also possible to form the profiled rod from the inner wall of the cylindrical screen away from the application surface or to provide it with at least one formed part projecting in this direction having the aforedescribed function support or rest, whereby the support piece can be arranged as desired inside or outside the application zone (FIG. 7).

The doctor blade according to the invention can be applied in its angular position also adjustably (i.e. axially pivotally, respectively support can be provided with an auxiliary adjustment device (FIG. 8). The output of the substance amount can be controlled through a variety of retaining-angle magnitudes (FIGS. 5 and 6).

The positioning can vary, depending on the respective operational conditions (peripheral speed of web or stencil, magnitude of the magnetic force, viscosity and amount of the substance to be applied and the set angular position). It also is possible to avoid the disadvantage inherent to the state of the art, namely the occurrence of unpredictable and uncontrollable distortions due to the difference in the mutual counteraction of position-determining magnetic and mechanical forces in various conditions of operation and their function-impairing and quality-affecting results, such as bending, uneven substance application over the width of the web and wear and tear.

Therefore, in accordance with the invention the following doctor blade element variants are possible: A rod which at the same time forms the doctor blade element (FIG. 9), a thin, elastically bendable doctor blade (FIG. 10), a doctor blade rod resilient to pressure and bending which can be formed in various ways (FIGS. 1, 2 and 7), a thin profiled bar, respectively a profiled rod, which can be either hard or pressure-resilient (FIG. 11), and the cross section of the profiled rod can also be circular (FIG. 12), the profiled rod with circular cross section can be slidably supported over more than 180° of its peripheral surface and this way designed as a roller, the rod or parts thereof, or parts inserted in the rod or fastened to it can be made of magnetizable material.

The difference with respect to the state of the art consists in the fact that there is no fastening device which determines the local position or the application area of the doctor blade, but over its entire length the doctor blade rod is held freely adjustable in its position, determining the application zone solely by magnetic force and therefore unimpaired by mechanical means.

An applicability of the doctor blade or doctor blade rod limited in both the pivoting, respectively swivelling directions, in conjunction with correspondingly shaped auxiliary devices extending the range of the invention can be used for the control of the axial pivoting, respectively swivelling and the setting of the angular position of the accumulation surface with respect to the application zone, and thereby for the control of the effect of the amounts to be applied (e.g. FIGS. 9, 13, 15, 16). A control is also possible by means of parallel or arc-shaped displacement of the counterparts in contact (FIGS. 13, 14, 15, 9 and 16). The contact parts can perform a circular motion so that the two circular swivel areas form an interengaging overlapping area (FIG. 15). However, the contact parts can be shaped and arranged so that the pivoting, respectively swivelling motion is derived from a positioning motion which is vertical or almost vertical with respect to the application plane (FIG. 16).

In practice, the handling of the doctor blade device of the invention takes place so that the optimal local position of the doctor blade 2 is determined by magnetic force, i.e. that the doctor blade 2 adjusting to the magnetic field is set into the optimal position with respect to the magnetic field and that then this angular position is fixed by auxiliary mechanical means, e.g. clamping.

This corresponds approximately in reverse order to the techniques used by the earlier state of the art, when the adjustment of the magnetic field to a mechanically predetermined local position was produced more or less forcibly.

This possibility of the mechanical fixation of the position previously magnetically determined takes into consideration that interruptions in the operation can occur, respectively that after disassembling, cleaning and reassembling of the same doctor blade device, at the same spot the position previously determined by the magnetic field does not have to be sought and established again, but can be found easily and without waste of setting time, reproduced by means of the auxiliary mechanical device.

I claim:

1. An apparatus for coating a web having a pair of opposite sides with a flowable substance, said apparatus comprising:

a coating station;

means defining a path for displacing the web along the path in a direction of displacement past the coating station;

a surface at the coating station engaging one side of the web and traveling in said direction;

magnetic means at said coating station along the one side of said web generating a magnetic field passing through said web;

means for applying a flowable substance to the other side of the web upstream in the direction from the coating station;

a doctor element at said coating station on the other side of said web and composed at least in part of a magnetically attractable material lying in said magnetic field, whereby said doctor element is drawn toward said web with a pressing force corresponding to a strength of the field in an operative state of the doctor element, the doctor element being in an inoperative state when the field is not generated by the magnetic means;

a wiper on said doctor element having an edge engaging the other side of the web and pressing said flowable substance onto said web and pressing the web against the surface traveling in said direction;

means mounting said doctor element free of connection with a fixed member in the operative state of the doctor element for at least limitedly shifting of the doctor element relative to said magnetic means in said direction exclusively by a combined action of said flowable substance, said surface and said magnetic field on said doctor element, whereby said doctor element is self-positioning with respect to said magnetic field; and means engageable with said doctor element and ineffective in said operative state for interfering with at least limited shifting of said doctor element relative to said magnetic means in said direction and thereby holding said doctor element in a selected angular orientation about said edge in the inoperative state of said doctor element.

2. The apparatus defined in claim 1, further comprising a stencil forming the surface and interposed between said edge and said web and through which said flowable substance is pressed onto said web, said doctor element being a horizontal bar extending across a width of said web.

3. The apparatus defined in claim 2 wherein said means engageable with said doctor element includes said stencil, said bar having an extension projecting in said travel direction and positioned to rest against said stencil in said inoperative state of said doctor element.

4. The apparatus defined in claim 3 wherein said bar has a further extension projecting in a direction opposite the direction in which the first mentioned extension projects to support said bar on said stencil in said inoperative state.

5. The apparatus defined in claim 2 wherein said means engageable with said doctor element includes a rest located laterally outside said stencil, said bar having an arm adapted to lie on said rest in said inoperative state.

6. The apparatus defined in claim 5 wherein said rest is provided with means for adjusting a height thereof.

7. The apparatus defined in claim 2 wherein said means engageable with said doctor element has an arm projecting toward said bar and said bar has an arm projecting toward said means engageable with said doctor element, one of said arms having a slot opening toward the other arm, said other arm having a rounded formation received in said slot.

8. The apparatus defined in claim 2 wherein said means engageable with said doctor element has a pair of adjustable spaced-apart abutments, said bar having an arm engaging with play between said abutments.

9. The apparatus defined in claim 2 wherein said bar is hollow and a block of the magnetically attractable material is received in said bar.

10. The apparatus defined in claim 2 wherein said wiper is a flexible blade.

11. The apparatus defined in claim 2 wherein said wiper is a round rod.

12. A device for treating a web having a pair of sides and moving in a travel direction along a path, said device comprising:

an application unit juxtaposed with one side of the web and defining an application zone, said application unit being provided with at least one magnetically attractable mass and with a doctor-blade element, said doctor-blade element assuming an angle in the application zone with respect to said web;

magnetic means juxtaposed with the other side of the web along the path thereof for generating a magnetic field crossing the web in a direction transverse to the travel direction for attracting the mass and pivoting said doctor-blade element into a working position with said doctor-blade element urged against said web with a pressing force that is primarily a function of a strength of said magnetic field;

means for applying a flowable substance to the one side of the web upstream of the application zone in the travel direction, whereby said magnetic field determines said working position and said pressing force;

means supporting said doctor-blade element for movement in the direction of travel of said web and in the transverse direction of the magnetic field application to position said doctor-blade element with respect to said web only by said magnetic field and the action of said substance on said doctor-blade element during operation of said device;

support means adjacent said path for limiting pivoting of said doctor-blade element in said working position, said application unit including a shoulder, said support means including retaining means for receiving said shoulder of the unit and having a pair of spaced-part horizontally movable stops for abutting said shoulder in said working position for maintaining an orientation of the latter upon removing said magnetic field.

13. A device for treating a web having a pair of sides and moving in a travel direction along a path, said device comprising:

an application unit juxtaposed with one of the sides of the web and defining an application zone, said application unit being provided with at least one magnetically attractable mass and with a doctor-blade element, said doctor-blade element assuming an angle in the application zone with respect to said web;

magnet means juxtaposed with the other side of the web along the path thereof for generating a magnetic field crossing the web in a direction transverse to the travel direction for attracting the mass and pivoting said doctor-blade element into a working position with said doctor-blade element urged against said web with a pressing force that is primarily a function of a strength of said magnetic field;

means for applying a flowable substance to the one side of the web upstream of the application zone in the travel direction, whereby said magnetic field determines said working position and said pressing force;

means supporting said doctor-blade element for movement in the direction of travel of said web and in the transverse direction of the magnetic field application thereto to permit positioning of said doctor-blade element with respect to said web only by said magnetic field and the action of said substance on said doctor-blade element during operation of said device;

support means adjacent said path for limiting excessive pivoting of said doctor-blade element in said working position, said unit including a shoulder, said support means including retaining means for receiving said shoulder of the unit, said support means being height-adjustable and said retaining means including:

an arm connected pivotally with said shoulder, a rotatable beam rigidly connected with said arm, and a supporting block mounted on said support and having a formation receiving said beam, so that said arm is movable along an arcuate path and guides said beam angularly.

* * * * *